US006138390A

United States Patent [19]

Wu

[11] Patent Number: 6,138,390

[45] Date of Patent: Oct. 31, 2000

[54] MULTI-FUNCTION IRONING BOARD

[76] Inventor: Hank Wu, 3Fl., No. 11, Lane 6, Shin Chung Street, Taipei, Taiwan

[21] Appl. No.: 09/328,341

[22] Filed: Jun. 9, 1999

[30] Foreign Application Priority Data

Mar. 8, 1999 [TW] Taiwan ..... 88203448

[51] Int. Cl.[7] ..... D06F 81/02

[52] U.S. Cl. ..... 38/112

[58] Field of Search ..... 38/103, 104, 112, 38/137; 108/11, 1, 28, 33, 50, 91, 157

[56] References Cited

U.S. PATENT DOCUMENTS

| | | | |
|---|---|---|---|
| 2,495,468 | 1/1950 | Mueller | 38/104 |
| 2,645,046 | 7/1953 | Frej | 38/104 X |
| 4,536,978 | 8/1985 | Cerutti | 38/103 |
| 5,329,710 | 7/1994 | Huddleston | 38/104 |

FOREIGN PATENT DOCUMENTS

| | | | |
|---|---|---|---|
| 732237 | 8/1948 | Denmark | 38/104 |
| 270827 | 6/1988 | European Pat. Off. | 38/103 |
| 1210404 | 4/1959 | Germany | 38/103 |
| 115100 | 7/1984 | Japan | 38/103 |

*Primary Examiner*—Ismael Izaguirre
*Attorney, Agent, or Firm*—Rosenberg, Klein & Lee

[57] ABSTRACT

A multi-function ironing board includes a frame to which a net member is fixed. The frame is supported by legs for being movable between a horizontal position and a vertical position. An electrical fan is mounted to one side of the frame and enclosed by a hood for safety purposes. The hood defines a central hole for air flows caused by the fan and passing through the net member. A board is removably attached to an opposite side of the frame for supporting clothes to be ironed thereon when the frame is at the horizontal position. The board is configured to allow air flows caused by the fan to pass therethrough thereby forming a retaining force to retain the clothes on the board. The board may also serve as a table when the frame is at the horizontal position. The multi-function ironing board may also serve as a regular electrical fan by removing the board and moving the frame to the vertical position.

13 Claims, 4 Drawing Sheets

MULTI-FUNCTION IRONING BOARD

FIELD OF THE INVENTION

The present invention generally relates to an ironing board, and in particular to a multi-function ironing board.

BACKGROUND OF THE INVENTION

Ironing boards are used to support clothes to be ironed. A household ironing board comprises a board supported on legs. The legs are usually foldable for storage purpose. The board of the household ironing board has a very limited surface area whereby when ironing large clothes, the clothes may slip off the board. Furthermore, although the legs of the ironing board are foldable for space saving purposes, the ironing board still occupies a space when not in use. Thus, it is desired to provide a multi-function ironing board for overcoming the above problems.

SUMMARY OF THE INVENTION

Accordingly, an object of the present invention is to provide an ironing board comprising clothes retaining device for securely retaining clothes to be ironed on the ironing board.

Another object of the present invention is to provide an ironing board incorporating a fan for generating a retaining force to retain clothes to be ironed on the ironing board.

A further object of the present invention is to provide an ironing board incorporating a fan therein.

A still further object of the present invention is to provide an ironing board which may serve as a table.

A still further object of the present invention is to provide an ironing board which may also serve as a regular electrical fan.

To achieve the above objects, in accordance with the present invention, there is provided an ironing board comprising a frame to which a net member is fixed. The frame is supported by legs for being movable between a horizontal position and a vertical position. An electrical fan is mounted to one side of the frame and enclosed by a hood for safety purposes. The hood defines a central hole for air flows caused by the fan and passing through the net member. A board is removably attached to an opposite side of the frame for supporting clothes to be ironed thereon when the frame is at the horizontal position. The board is configured to allow air flows caused by the fan to pass therethrough thereby forming a retaining force to retain the clothes on the board. The board may also serve as a table when the frame is at the horizontal position. The multi-function ironing board may also serve as a regular electrical fan by removing the board and moving the frame to the vertical position.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
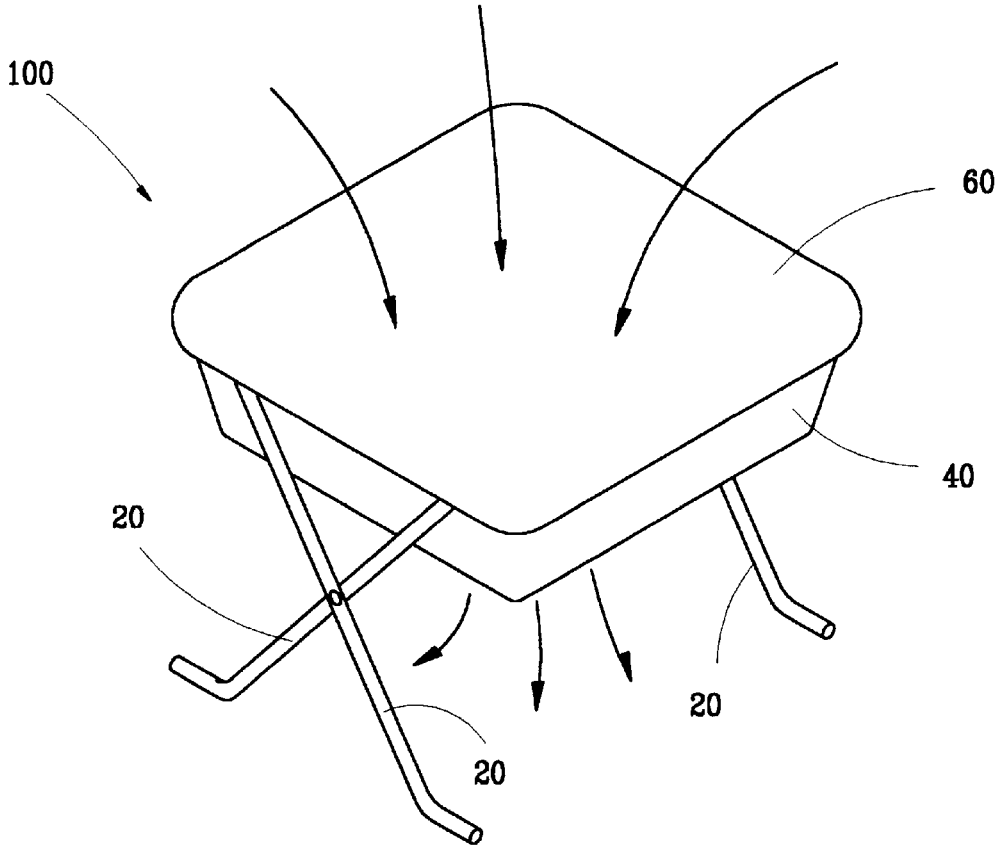
FIG. 1 is a perspective view of a multi-function ironing board constructed in accordance with the present invention.
Figure 2:
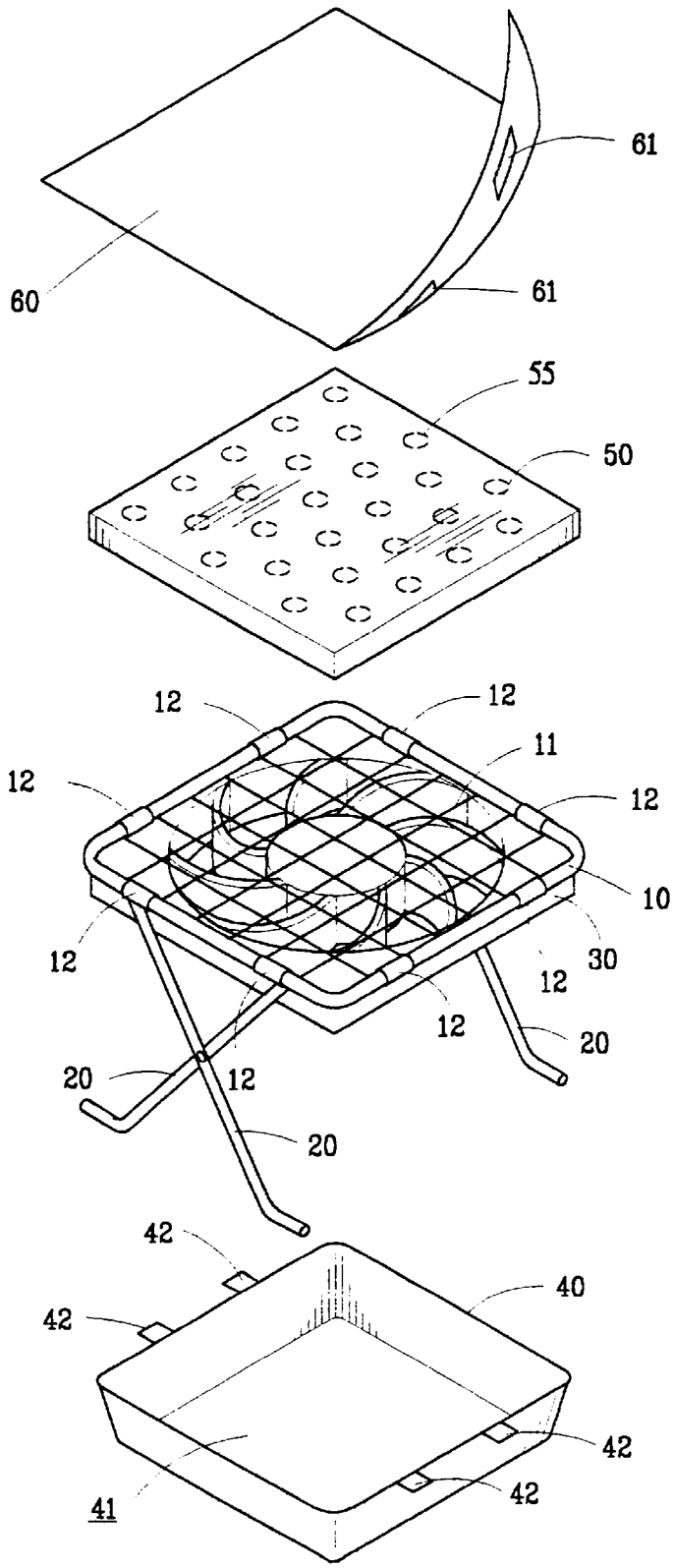
FIG. 2 is an exploded view of the multi-function ironing board.
Figure 4:
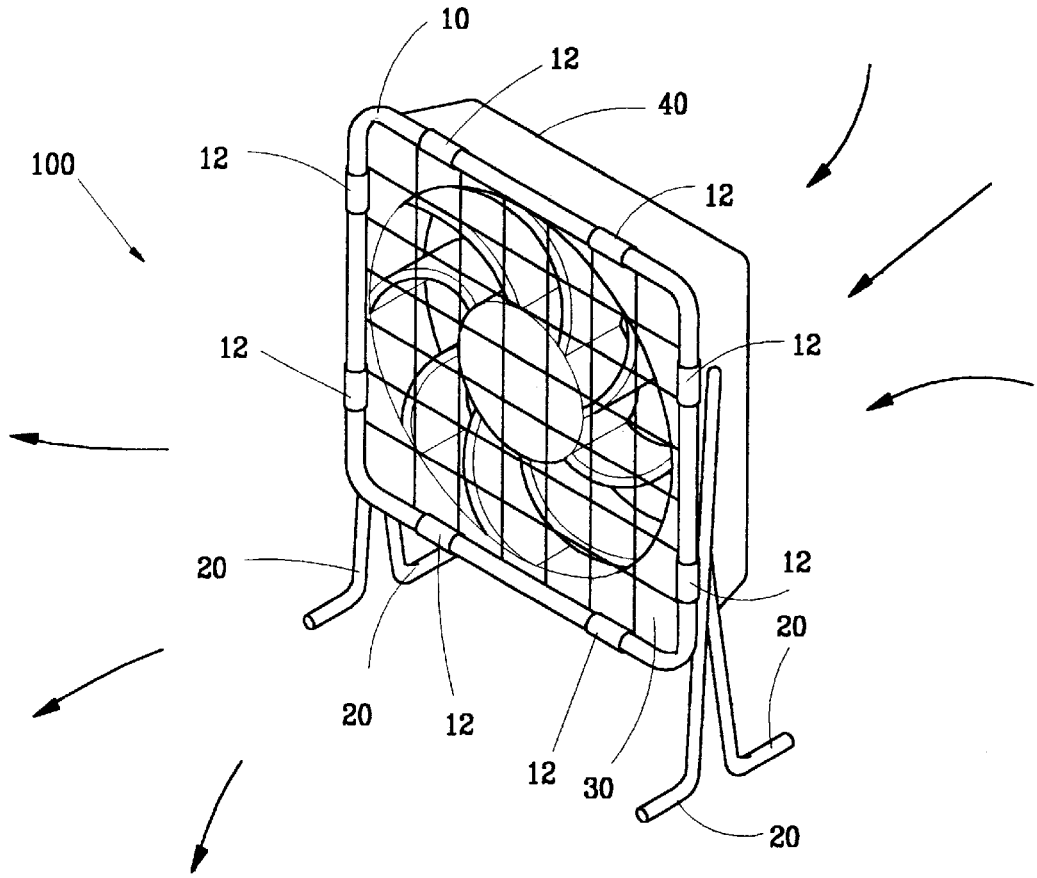
FIG. 4 is a perspective view showing the multi-function ironing board serving as a regular electrical fan.

With reference to the drawings and in particular to FIGS. 1 and 2, wherein a multi-function ironing board constructed in accordance with the present invention, generally designated by reference numeral 100, is shown, the multi-function ironing board 100 comprises a frame 10 to which a net member 11 is fixed. The frame 10 may be of any desired configuration and is rectangular in the embodiment illustrated. Two pairs of legs 20 are detachably mounted to the frame 10 for supporting the frame 10 in a substantially horizontal position. Each pair of legs 20 are pivoted to each other for being foldable with respect to each other. One of the legs 20 of each pair is pivoted to the frame 10 while the other leg 20 releasably engages with and thus separable from the frame 10 whereby the frame 10 is allowed to move from the horizontal position to a substantially vertical position (FIG. 4).

Figure 3:
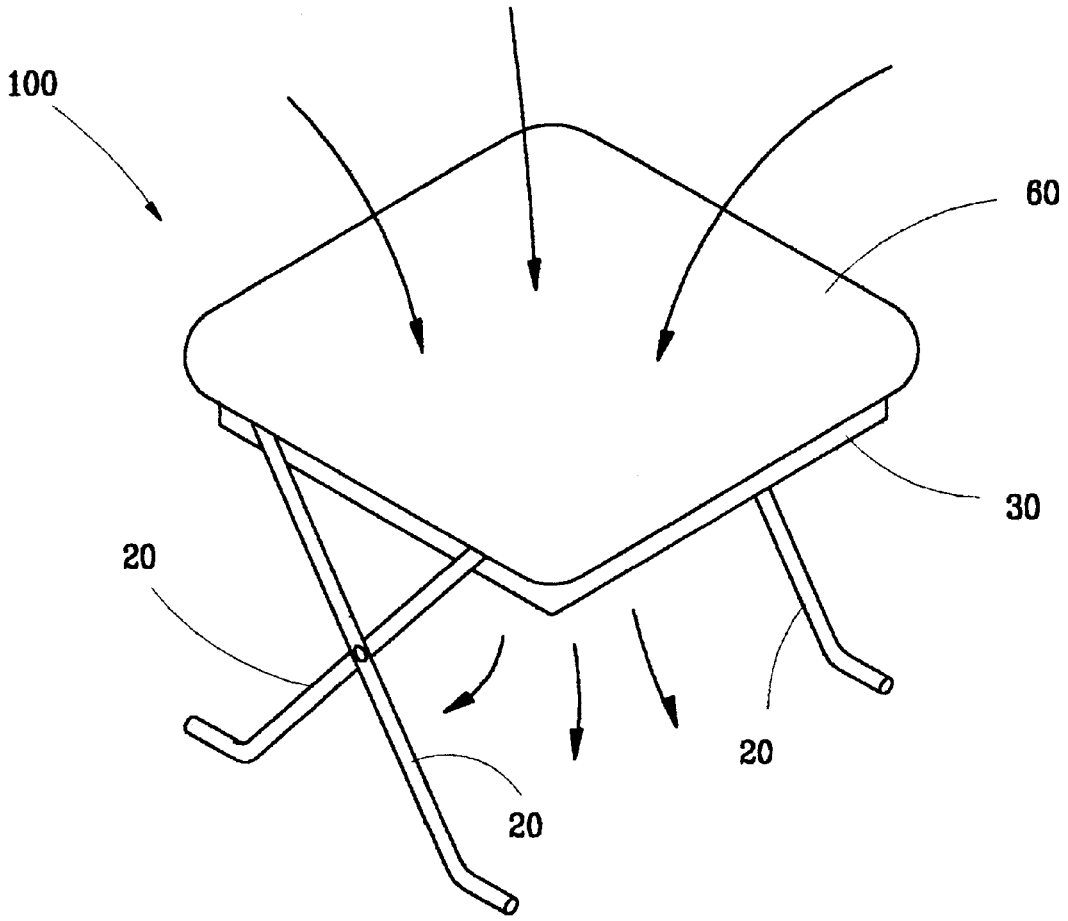
FIG. 3 is a perspective view showing the multi-function ironing board serving as a table.

An airflow generation device 30, such as an electrical fan, is attached to a lower side of the frame 10 for generating air flows through the net member 11 as indicated by arrows in FIGS. 1 and 3. A safety hood 40 is attached to the lower side of the frame 10 for substantially enclosing the airflow generation device 30 thereby preventing accidental contact by a user. A central opening 41 is defined in the hood 40 through which air flows. Releasable retaining means is provided between the hood 40 and the frame 10 for releasably retaining the hood 40 to the frame 10. As shown in the drawings, an example of the releasable retaining means comprises loop-and-hook fastening members each comprising a first or loop portion 42 fixed to the hood 40 and a second or hook portion 12 fixed to the frame 12. The loop portions 42 are releasably engageable with the corresponding hook portions 12 for retaining the hood 40 to the frame 10. Apparently, other releasable retaining device or elements may also be employed without departing from the spirit of the present invention.

The multi-function ironing board 10 of the present invention further comprises a board 50 enclosed by a flexible enclosure 60 which can be made of cloth. Additional loop portions 61 are mounted on the enclosure 60 for engaging with additional hook portions 12 fixed on the frame 10 thereby releasably attaching the board 50 to form an air-sealing condition, together with the enclosure 60, to an upper side of the frame 10. When serving as an ironing board, the board 50 is made of a soft and temperature-resistant material capable ( such as sponge ) of accommodating air flowing therethrough whereby when the airflow generation device 30 is actuated, air flows are generated and pass through the board 50 which provides a retaining force for effectively retaining clothes placed on the board 50. The air flows also remove the steam generated in ironing clothes thereby preventing humidity absorbed by the clothes.

In another application of the multi-function ironing board 100 of the present invention, the frame 10 is maintained in the horizontal position and the soft board 50 may be replaced by a rigid board 50 thereby serving as a table. Through 55 holes may be formed in the rigid board 50 through which air flows caused by the airflow generation device 30 may pass for comforting a user of the table. The hood 40 may be removed if desired, as shown in FIG. 3. In this case and alternatively, the enclosure 60 may comprise a soft pad 65 therein for being positioned on the board 50 for clothes-ironing purposes.

In a further application of the multi-function ironing board 100 of the present invention, as shown in FIG. 4, the frame 10 is moved to the vertical position and the board 50 is removed. The airflow generation device 40 may now serve as a regular fan for generating air streams for cooling purposes. In this condition, the airflow generation device 30 rotate reversely in order to act as an electric fan. Thus, even when the multi-function ironing board 100 is not serving as an ironing board for processing clothes, the multi-function ironing board 100 also provides an additional function as an electrical fan.

Although the present invention has been described with respect to a preferred embodiment, it is contemplated that a variety of modifications, variations and substitutions may be done without departing from the scope of the present invention that is intended to be defined by the appended claims.

What is claimed is:

1. A multi-function ironing board system comprising:

(a) a frame defining an opening and including a net member extending thereacross;

(b) a plurality of legs collapsibly coupled to said frame for supporting said frame selectively in one of at least a horizontal configuration and a vertical configuration;

(c) an airflow generation device coupled to said frame and disposed at least partially within said opening, said airflow generation device being operable to generate airflow through said net member of said frame; and, (d) a board member removably coupled to said frame and disposed to extend substantially across said net member, said board member being pervious to the airflow generated by said airflow generation device, said board member having an upper surface.

2. The multi-function ironing board as recited in claim 1 further comprising an enclosure substantially enveloping said upper surface of said board member, whereby by an article may be retained thereon for ironing by the airflow generated by said airflow generation device.

3. The multi-function ironing board as recited in claim 2 wherein said board member is formed of a resilient and heat resistant material.

4. The multi-function ironing board as recited in claim 1 wherein said board member is formed of a substantially rigid material for supporting an article placed thereon in stable manner.

5. The multi-function ironing board as recited in claim 4 further comprising an enclosure substantially enveloping said upper surface of said board member.

6. The multi-function ironing board as recited in claim 5 wherein said enclosure includes a resilient pad, whereby by an article may be retained thereon for ironing by the airflow generated by said airflow generation device.

7. The multi-function ironing board as recited in claim 6 wherein said board member has formed therein a plurality of through holes.

8. The multi-function ironing board as recited in claim 1 further comprising a plurality of fastening members coupled to said board member and frame for the releasable securing thereof one to the other.

9. The multi-function ironing board as recited in claim 8 wherein each said fastening member includes a hook-and-loop type fastening pair.

10. The multi-function ironing board as recited in claim 1 wherein said airflow generation device includes an electric fan, whereby said multi-function ironing board is operable to circulate air upon disposing said frame in said vertical configuration and removing said board member therefrom.

11. The multi-function ironing board as recited in claim 1 further comprising a hood coupled to said frame for protectively encircling said airflow generation device, said hood defining a central opening for maintaining open access to said airflow generation device.

12. The multi-function ironing board as recited in claim 11 further comprising a plurality of fastening members coupled to said hood and frame for the releasable securing thereof one to the other.

13. The multi-function ironing board as recited in claim 12 wherein each said fastening member includes a hook-and-loop type fastening pair.

* * * * *